US009115934B2

(12) United States Patent
Kopchick et al.

(10) Patent No.: US 9,115,934 B2
(45) Date of Patent: Aug. 25, 2015

(54) HEAT EXCHANGER FLOW LIMITING BAFFLE

(75) Inventors: Christopher Kopchick, Milford, MI (US); Michiyasu Yamamoto, Chiryu (JP)

(73) Assignees: DENSO International America, Inc., Southfield, MI (US); DENSO CORPORATION, Kariya-shi, Aichi-ken ( * ) Notice: Subject to any disclaimer, the term of this patent is extended or adjusted under 35 U.S.C. 154(b) by 978 days.

(21) Appl. No.: 12/723,757

(22) Filed: Mar. 15, 2010

(65) Prior Publication Data

US 2011/0220318 A1 Sep. 15, 2011

(51) Int. Cl.

| | |
|---|---|
| ***F28F 9/02*** | (2006.01) |
| ***F28D 1/053*** | (2006.01) |
| *F28D 21/00* | (2006.01) |

(52) U.S. Cl.

CPC ..... *F28D 1/05375* (2013.01); *F28F 9/028* (2013.01); *F28F 9/0209* (2013.01); *F28F 9/0212* (2013.01); *F28D 2021/0084* (2013.01); *F28F 2265/26* (2013.01)

(58) Field of Classification Search

CPC .... F28F 9/0217; F28F 9/0212; F28D 1/05375
USPC ..... 165/101, 153, 41, 174, 139, 104.32, 165/917, 140
See application file for complete search history.

(56) References Cited

U.S. PATENT DOCUMENTS

| | | | | |
|---|---|---|---|---|
| 3,132,690 | A | 5/1964 | Suchomel | |
| 4,596,287 | A | 6/1986 | Wissmath | |
| 5,186,245 | A | 2/1993 | Peters | |
| 5,894,886 | A * | 4/1999 | Chiba et al. | 165/174 |
| 6,062,303 | A * | 5/2000 | Ahn et al. | 165/110 |
| 6,116,335 | A | 9/2000 | Beamer et al. | |
| 6,272,881 | B1 * | 8/2001 | Kuroyanagi et al. | 62/525 |
| 6,449,979 | B1 * | 9/2002 | Nagasawa et al. | 62/503 |
| 6,789,613 | B1 * | 9/2004 | Ozaki et al. | 165/140 |
| 6,942,023 | B2 * | 9/2005 | Fang et al. | 165/140 |
| 6,997,143 | B2 * | 2/2006 | Piccirilli et al. | 123/41.1 |
| 7,059,393 | B2 * | 6/2006 | Fang et al. | 165/140 |
| 7,096,930 | B2 * | 8/2006 | Nobuta et al. | 165/132 |
| 7,096,932 | B2 * | 8/2006 | Scoville et al. | 165/140 |
| 7,306,030 | B2 * | 12/2007 | Luvisotto et al. | 165/284 |
| 7,506,683 | B2 * | 3/2009 | Hu | 165/140 |
| 7,669,558 | B2 * | 3/2010 | Claypole et al. | 123/41.51 |
| 7,699,028 | B2 * | 4/2010 | Guerrero et al. | 123/41.29 |
| 2005/0269062 | A1 * | 12/2005 | Guerrero et al. | 165/101 |
| 2006/0207755 | A1 * | 9/2006 | Kalbacher | 165/140 |

(Continued)

*Primary Examiner* — Marc Norman
*Assistant Examiner* — Devon Russell
(74) *Attorney, Agent, or Firm* — Harness, Dickey & Pierce, P.L.C.

(57) ABSTRACT

A heat exchanger, such as a radiator, may transfer heat from a liquid and employ a first header tank, a second header tank, a plurality of tubes fluidly joining the first and second header tanks, and a baffle within one of the first or second header tanks. The baffle may be located in a header tank positioned substantially parallel or perpendicular to a surface upon which a vehicle employing the hear exchanger rests. The baffle may be a wall defining only one slot, a wall defining only one slot that is open through one side of the wall, a wall that defines a plurality of slots, or a wall that defines a plurality of holes. The heat exchanger may further employ fluidly isolated first and second tube and fin sections each defining a self-contained flow path for cooling different liquids. The baffle may slow coolant flow in a flow path.

25 Claims, 5 Drawing Sheets

(56) References Cited

U.S. PATENT DOCUMENTS

2007/0131393 A1* 6/2007 Sasaki ..... 165/110
2008/0023185 A1* 1/2008 Beamer et al. ..... 165/174
2009/0120627 A1* 5/2009 Beamer et al. ..... 165/174

* cited by examiner

HEAT EXCHANGER FLOW LIMITING BAFFLE

FIELD

The present disclosure relates to a baffle within a heat exchanger.

BACKGROUND

This section provides background information related to the present disclosure which is not necessarily prior art. With reference to FIG. 1, current vehicles may employ one or more heat exchangers 2, 4, such as radiator 2 and condenser 4, to cool liquids that are continuously circulated through heat generating devices on the vehicle. Regarding a radiator 2, liquid coolant may first be passed through an internal combustion engine before the coolant is circulated through radiator 2 to be cooled. Similarly, a vehicle air-conditioning system may compress a refrigerant that is then cooled by being passed through condenser 4. Airflow 6 and a fan 8 may assist in delivering air through each of radiator 2 and condenser 4. A shroud 10 may further assist in directing airflow. However, such an arrangement may be subject to improvement. For instance, when heated liquids are introduced into a heat exchanger, thermal strain may develop at specific locations of the heat exchanger. Area 12 depicts an area of radiator 2 that is blocked by airflow 6 and thus may experience thermal strain. Thermal strain occurs during expansion and contraction created during heating and cooling of the material that forms the rigid and connected coolant channels of heat exchanger 2. The rate at which heating and cooling occurs depends upon the temperature, flow rate and quantity of heat of incoming liquid supplied into and through material of heat exchanger 2 relative to the temperature and rate of change of the temperature of material of the heat exchanger at the location at which the incoming liquid is received.

FIG. 2 depicts a cross-flow heat exchanger 16 that exhibits thermal strain within a material of heat exchanger 16. More specifically, a liquid 18 flows into inlet 14 and horizontally across a bottom portion 20 of heat exchanger 16 before flowing into a top portion 22 of heat exchanger 16 and out outlet 17. Liquid 18 flow transitions from flowing horizontally across bottom portion 20 to top portion 22 at header tank 26. Because liquid 18 cools while passing across and through a bottom portion 20 and also while passing across a top portion 22, thermal strain may occur at the juncture or adjacent portions of bottom portion 20 and top portion 22. As an example, at area 28 is a location that experiences simultaneous contact with the highest temperature of liquid 18 and the lowest temperature of liquid 24. FIG. 2 also graphically presents a representative heat differential within heat exchanger 16. With mean temperature increasing from left to right on temperature distribution graph 30, one may see that the mean temperature 32 of liquid 18 in bottom portion 20 is higher than the mean temperature 34 of liquid 24 in top portion 22. Thus, across a juncture of lower portion 20 and upper portion 22, such as at area 28, greatest expansion and contraction of the material of heat exchanger 16 may occur. Such a heat differential may cause cracks and hasten leaks from heat exchanger 16. What is needed then is a structure and method for controlling thermal strain on a heat exchanger.

SUMMARY

This section provides a general summary of the disclosure, and is not a comprehensive disclosure of its full scope or all of its features. A heat exchanger for transferring heat from a liquid may employ a first header tank, a second header tank, a plurality of tubes fluidly joining the first header tank and the second header tank, and a baffle within one of the first header tank and the second header tank.

In another arrangement, a heat exchanger for transferring heat from a liquid may employ a first header tank, a second header tank, a plurality of tubes fluidly joining the first header tank and the second header tank, and a baffle within one of the first header tank and the second header tank. The heat exchanger may further employ a first tube and fin section defining a first flow path for cooling a first liquid, and a second tube and fin section defining a second flow path for cooling a second liquid, wherein the first and second tube and fin sections are fluidly isolated from each other and the baffle slows coolant flow in the first tube and fin section. The heat exchanger may be a radiator within a vehicle, such as an automobile, and the baffle may be located in a header tank positioned substantially parallel to a surface of ground upon which the vehicle rests. The heat exchanger may be a radiator within a vehicle and the baffle may be located in a header tank positioned substantially perpendicular to a surface of ground upon which the vehicle rests. The baffle may be a wall that defines only one slot, or the baffle may be a wall that defines only one slot that is open through one side of the wall. Still yet, the baffle may be a wall that defines a plurality of slots that are open through a same side of the wall or the baffle may be a wall that defines a plurality of holes.

A heat exchanger for transferring heat from a liquid may employ a first header tank, a second header tank, a plurality of tubes fluidly joining the first header tank and the second header tank, and a baffle within one of the first header tank and the second header tank. The heat exchanger may further employ a first tube and fin section defining a first flow path for cooling a first liquid, and a second tube and fin section defining a second flow path for cooling a second liquid, wherein the first and second tube and fin sections are fluidly isolated from each other and the baffle slows coolant flow in the first tube and fin section. The heat exchanger may be a radiator within a vehicle and the baffle may be located in a header tank positioned substantially parallel or perpendicular to a surface of ground upon which the vehicle rests. The baffle may be a wall that defines only one slot, a wall that defines a single through hole through the wall to permit passage of fluid or a wall that defines a plurality of slots that may be open through a same side of the wall.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
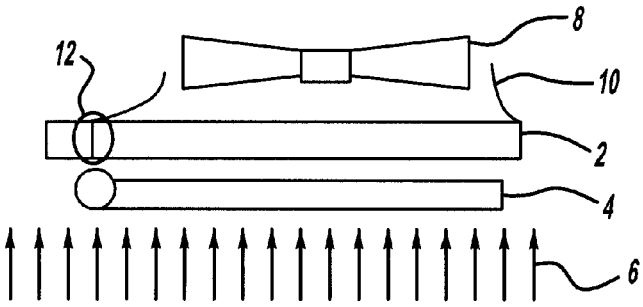
FIG - 1 Prior Art
FIG. 1 is a top view of a heat exchanger with a condenser situated in front of the heat exchanger according to the prior art.

Example embodiments will now be described more fully with reference to FIGS. 3-11 of the accompanying drawings. It should be understood that throughout the drawings, corresponding reference numerals indicate like or corresponding parts and features. Beginning with FIG. 3, a vehicle 50, such as an automobile for example, may be equipped with a device such as an engine 52 and a heat exchanger 54, which may be a radiator for cooling a liquid coolant that flows through engine 52 and heat exchanger 54. It should be understood that the teachings of the present disclosure may be applicable to many different types of heat exchangers, whether such heat exchangers are made of metal or plastic. Examples of heat exchangers to which the present disclosure may be applicable to include transmission cooler heat exchangers, such as those used to cool transmission fluid of another device such as an automatic transmission, heater core heat exchangers, such as those used to transfer heat to a passenger compartment of a vehicle, and heat exchangers employed in another device such as vehicle air conditioning systems. Heat exchangers employed in vehicle air conditioning systems include a condenser and an evaporator, both of which are employed to reduce the temperature of an internal refrigerant, whether in a liquid or gaseous phase, or both.

Figure 4:
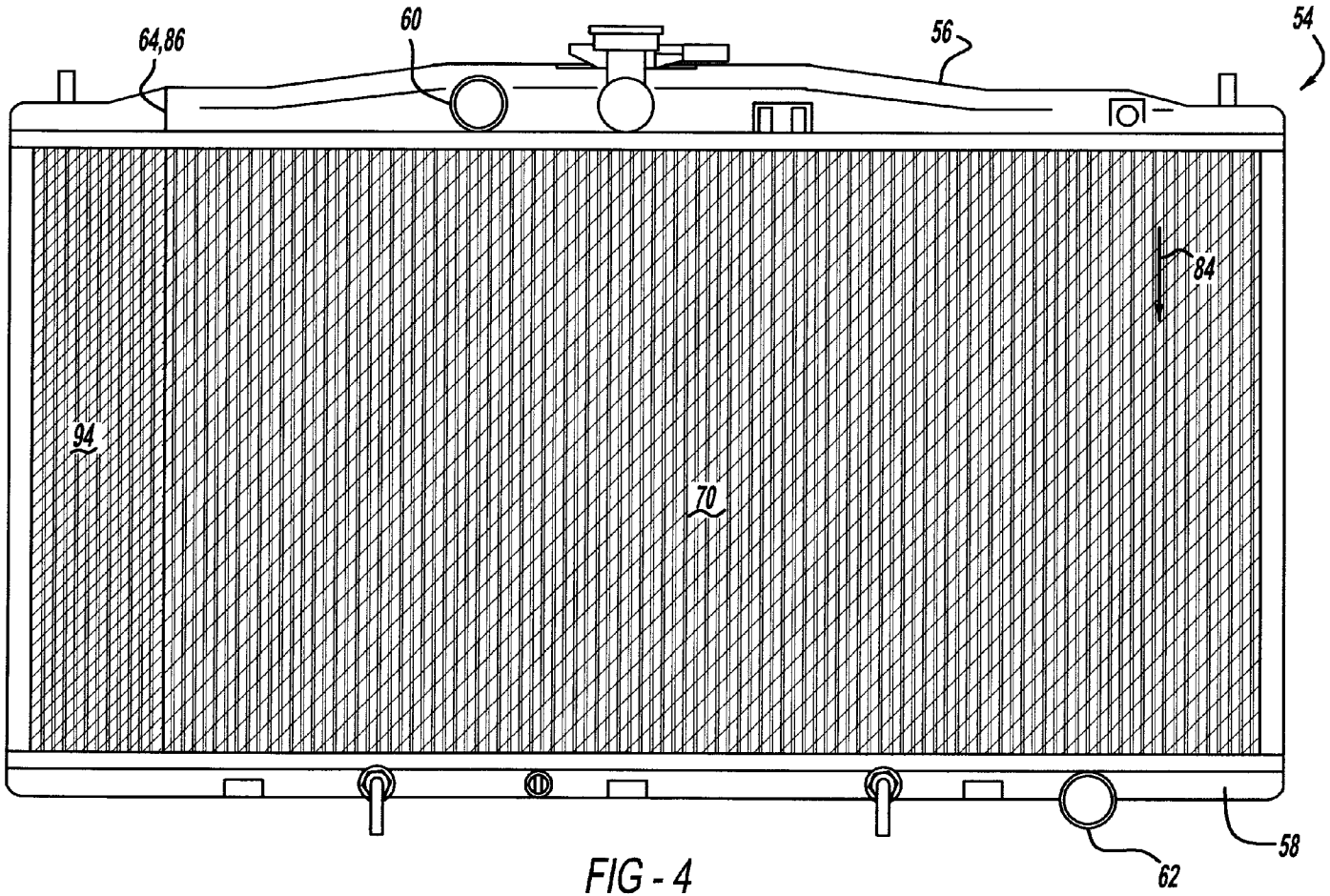
FIG. 4 is a front view of a heat exchanger depicting a location of an interior baffle in accordance with the present disclosure.
Figure 5:
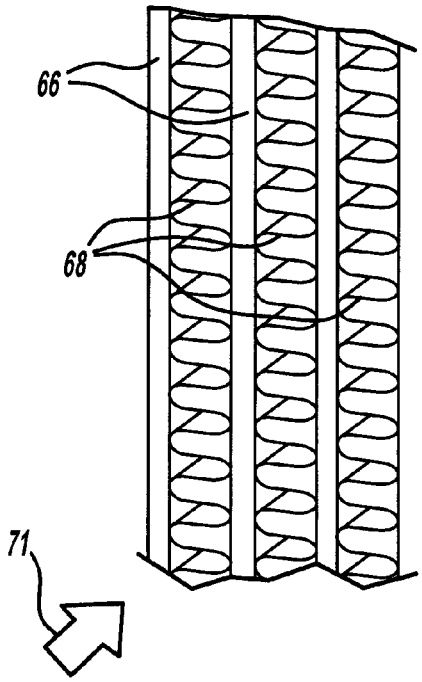
FIG. 5 is a perspective view of a tube and fin arrangement in accordance with the present disclosure.

Turning now to FIG. 4, heat exchanger 54 may have an upper tank 56 and a lower tank 58, both also known as header tanks, a fluid inlet 60 in upper tank 56 and a fluid outlet 62 in lower tank 58. Heat exchanger 54 in some aspects may be similar to existing heat exchangers. For instance, as depicted in FIG. 5, heat exchanger 54 may be equipped with metal or plastic hollow tubes 66, arranged in a parallel fashion, such as horizontally or vertically for example, through which a coolant in either a liquid or gaseous phase may flow. Hollow tubes 66 may then be connected to each other with a corrugated, relatively thin metal or plastic fin 68. As an example, fins 68 may be made of aluminum and conduct or transfer heat from tubes 66. Heat transferred to fins 68 may then again be transferred to air 71 that flows over exterior surfaces of fins 68 as air 71 flows through a core portion 70, 94 of heat exchanger 54. Core portions 70, 94 may employ tubes 66 and fins 68 and may be considered part of core portions 70, 94. Generally, throughout the description, tube and fin portions may collectively be considered a core portion. Continuing, FIG. 4 depicts vertically arranged tubes 66 of core portion 70; however, tubes 66 of core portion 70 may also be arranged horizontally. Tubes 66 arranged horizontally and vertically are determined to be oriented as such relative to a surface upon which vehicle 50 may be parked when tubes 66 are resident in heat exchanger 54 when heat exchanger 54 is used as a radiator of engine 52, for example. Heat exchanger 54 may also be equipped with an internal baffle 64 in a header tank, such as upper tank 56. Baffles in header tanks, will now be explained in greater detail.

Figure 6:
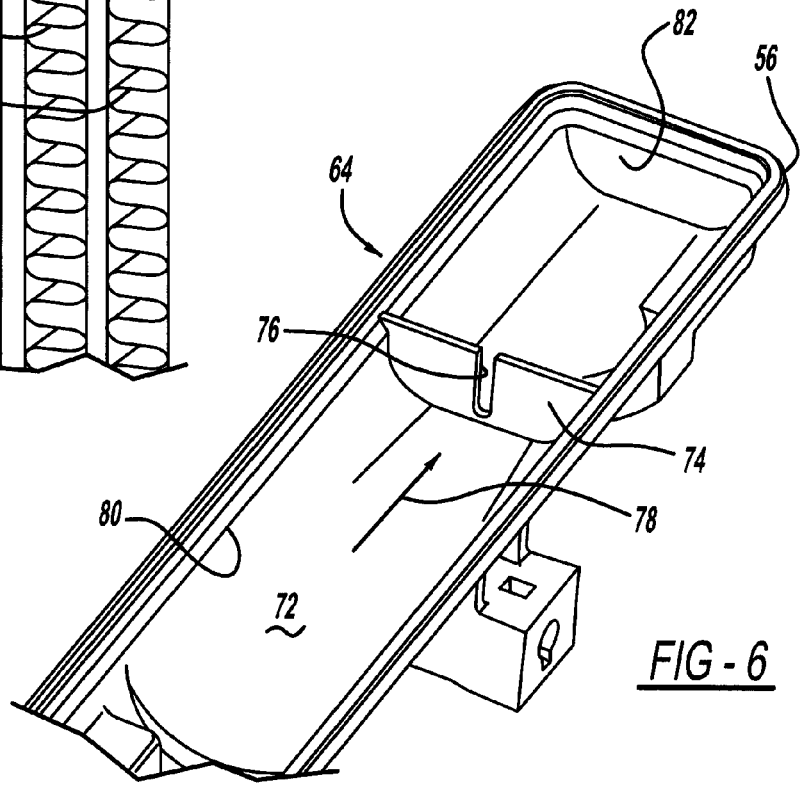
FIG. 6 is a perspective interior view of a radiator header tank depicting a location of an interior baffle in accordance with the present disclosure.
Figure 7:
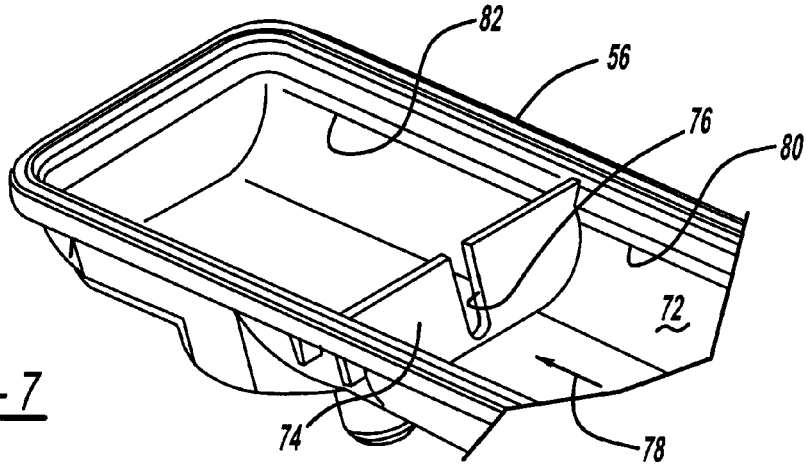
FIG. 7 is a perspective view of an interior of a header tank depicting an interior baffle in accordance with the present disclosure.

FIG. 4 depicts a location of baffle 64, which may be located at any position along a longitudinal length of any header tank 56, 58, for example, of heater exchanger 54. FIGS. 6 and 7 depict header tank 56 removed from core portion 70, 94 of heat exchanger 54 and reveal an internal surface 72, which may be curved or concave. Header tank 56, which may be an upper header tank, may be equipped with an internal baffle 64, which may be a wall 74 having two flat, parallel sides or surfaces, for example. Continuing, wall 74 may have only a single slot 76, acting as a communication portion, in it to permit the flow of liquid from one side of wall 74 to another side of wall 74, that is between a chamber on each side of wall 74. More specifically, slot 76 may permit liquid coolant 78 to pass from chamber 80 to chamber 82 of header tank 56. Wall 74 with slot 76 will reduce the volume flow rate (volume of liquid per unit time) of liquid coolant that is able to enter chamber 82 of header tank 56 as compared to a structure in which baffle 64 is absent. By reducing the volume flow rate of liquid coolant 78 entering chamber 82, the quantity of heat entering chamber 82 will also be reduced. With reference again to FIG. 4, when header tank 56 is installed as part of heat exchanger 54, baffle 64 may be located anywhere along header tank 56 depending upon the particular mechanical design of a heat exchanger, including the number of tubes, orientation of tubes, number of liquids cooled by the heat exchanger, etc. The heat transfer characteristics as revealed by a heat transfer analysis using finite element analysis ("FEA") on the particular mechanical design may also dictate a particular location of baffle 64 within header tank 54. Regarding FIG. 4, core portion 70 of heat exchanger 54 has vertically oriented tubes 66, and thus, liquid coolant generally flows downward from upper tank 56 to lower tank 58 in a vertical fashion as indicated with arrow 84.

Figure 8:
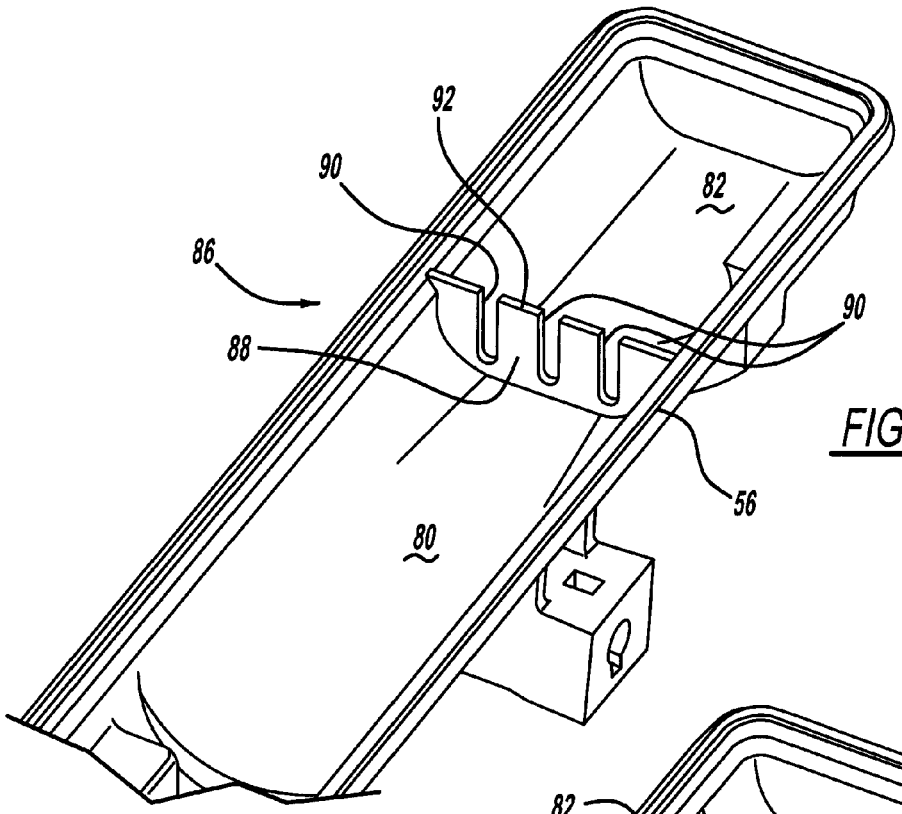
FIG. 8 is a perspective view of an interior of a header tank depicting an interior baffle in accordance with the present disclosure.

FIG. 8 depicts another embodiment. Baffle 86 is similar to baffle 64 in that a wall 88 having parallel and flat surfaces may have multiple through slots 90, acting as a communication portion, passing entirely though a thickness dimension of wall 88 and through an edge or side of wall 88. A complete longitudinal edge or longitudinal surface 92, which may span between opposing longitudinal sides of upper tank 56, of wall 88 may abut against an end of tubes 66 so that flowing liquid flowing in upper tank from chamber 80 to chamber 82 must flow through slots 90, which may be considered a through slot 90 because such slot passes completely through a side and peripheral edge of wall 88 and slots 90 are not completely surrounded by material of wall 88. Because the cross-sectional area of slots 90 within wall 88 presents less area for liquid coolant to pass through than if wall 88 were not in place, the volume of liquid flowing from chamber 80 to chamber 82 of upper tank 56 may be reduced. Because the flow rate of liquid flowing into chamber 82 is reduced, the quantity of heat in the liquid is reduced, and thus, the temperature of the radiator tubes and fins beyond and below baffle 86, for example, may be reduced. "Beyond" baffle 86 means the volume of space that is chamber 82. Below baffle 86 means the volume of space that is below chamber 82, relative to when heat exchanger 54 is installed in vehicle 10 that is parked on a level surface. For instance, with reference again to FIG. 4, "beyond and below" baffle 64 or baffle 86, depending upon which particular baffle is installed, is indicated as area 94. The area beyond and below a baffle within a header tank may change as the location of the baffle changes in a top-mounted header tank, such as header tank 56.

Figure 9:
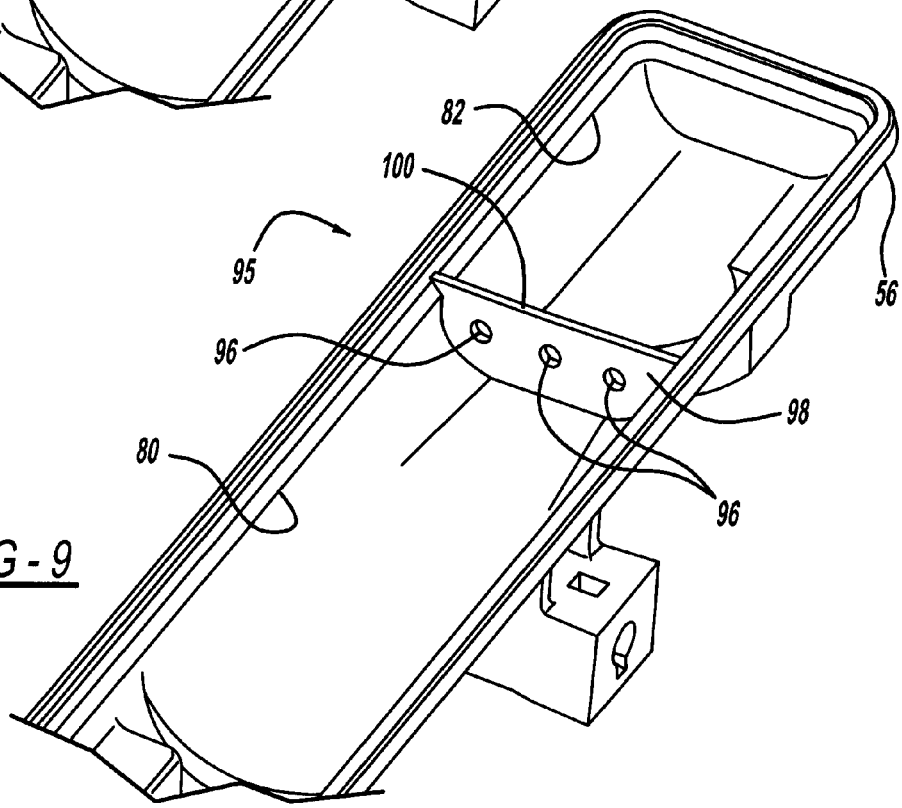
FIG. 9 is a perspective view of an interior of a header tank depicting an interior baffle in accordance with the present disclosure.

FIG. 9 depicts another embodiment. Baffle 95 is similar to baffles 64, 86 in that a wall 88 having parallel and flat surfaces may have through holes 96, acting as communication portions, passing entirely though a thickness dimension of wall 98. A longitudinal surface or longitudinal edge 100 of wall 98 may abut against an end of tubes 66 so that flowing liquid flowing in upper tank from chamber 80 to chamber 82 must flow through holes 96. Because the cross-sectional area of holes 96 within wall 98 presents less area for liquid coolant to pass through than if wall 98 were not in place at all, the volume of liquid flowing from chamber 80 to chamber 82 of upper tank 56 is reduced. Because the flow rate of liquid flowing into chamber 82 is reduced, compared to if wall 98 were not in place at all, the quantity of heat passing to chamber 82 is reduced, and thus, the temperature of the radiator tubes and fins beyond and below baffle 95, for example, may be reduced, as explained above.

Figure 10:
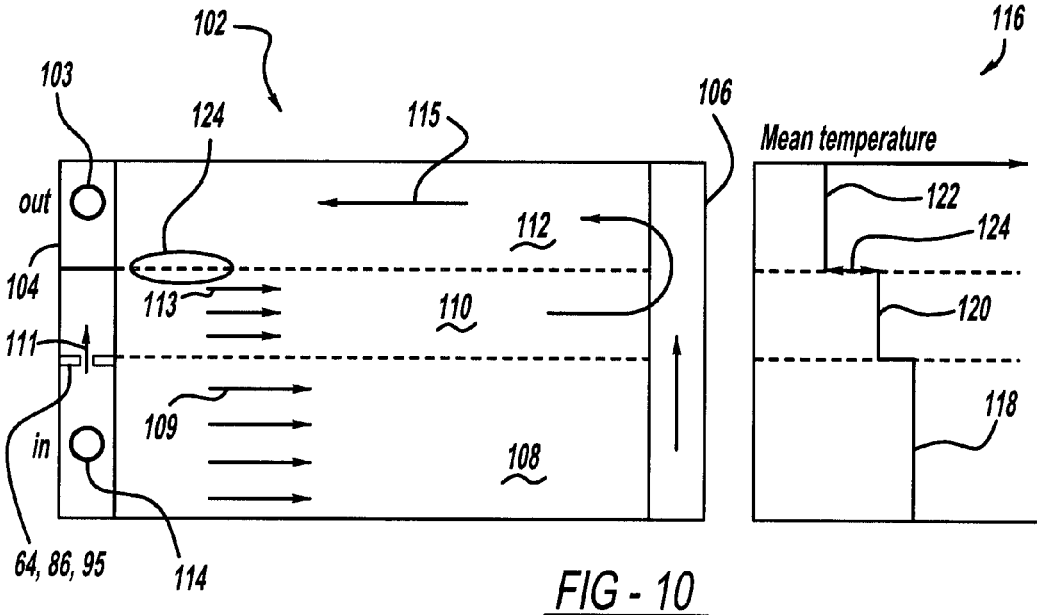
FIG. 10 is a diagram of a cross-flow heat exchanger and associated temperature distribution in accordance with the present disclosure.

Turning now to FIG. 10, a cross-flow heat exchanger 102 is depicted in which baffle 64, 86, 95 may be resident within end tank 104. Because heat exchanger 102 is a cross-flow heat exchanger, liquid coolant flows horizontally through tube and fin portions 108, 110, 112 between end tanks 104, 106. More specifically, liquid coolant may enter cross-flow heat exchanger 102 at an inlet 114 located near a bottom of end tank 104. Upon entering, some liquid coolant 109 will begin to flow horizontally through tube and fin portion 108 while some liquid coolant 111 will continue to flow vertically through end tank 104, through an internal baffle within end tank 104, and then horizontally through tube and fin portion 110. Baffle within end tank 104 may be any of baffles 64, 86, 95 previously presented, for example. Tube and fin portions 108, 110, 112 may be of a similar construction to tubes 66 and fins 68 explained in conjunction with FIG. 5, although oriented with tubes 66 horizontally instead of vertically.

Continuing, baffle 64, 86, 95 may restrict the flow of fluid through end tank 104 and thus also restrict the quantity of heat (i.e. heat rate) resulting in a temperature of liquid coolant 113 within tube and fin portion 110 that is less than that of tube and fin portion 108. Upon liquid coolant flowing through tube and fin portions 108, 110, liquid coolant flows vertically again within end tank 106 at an opposite end of cross-flow heat exchanger 102 as end tank 104. Tube and fin portion 112 then receives liquid coolant 115 from end tank 106. Tube and fin portion 112 may be the uppermost tube and fin portion of cross-flow heat exchanger 102. Upon flowing through tube and fin portion 112, liquid coolant 115 then exits cross-flow heat exchanger 102 at outlet 103.

Figure 2:
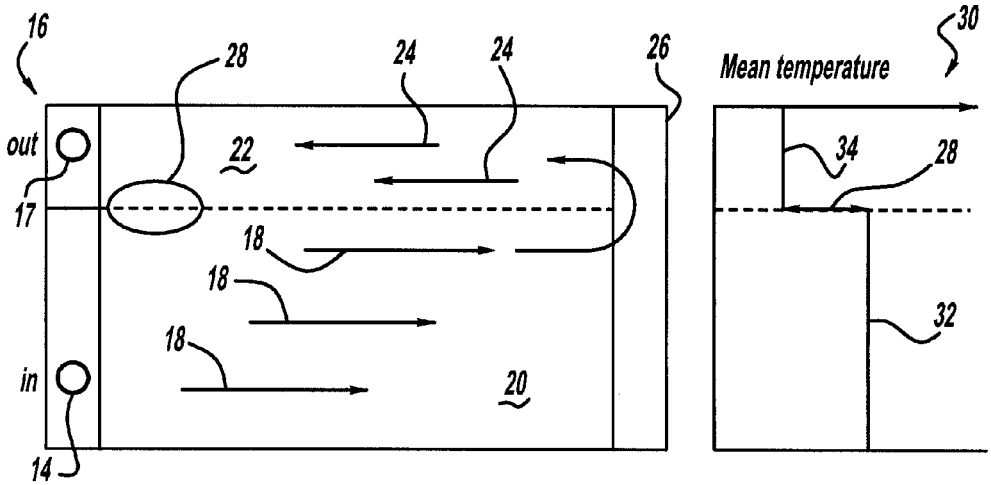
FIG - 2 Prior Art
FIG. 2 is a diagram of a cross-flow heat exchanger and associated heat exchanger according to the prior art.
Figure 3:
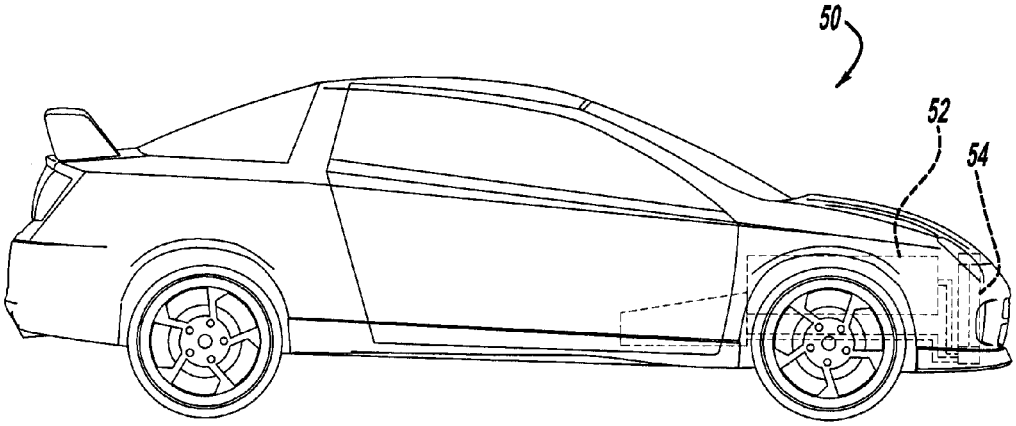
FIG. 3 is a side view of a vehicle depicting the location of an engine and heat exchanger in accordance with the present disclosure.

Temperature distribution graph 116 of FIG. 10 graphically depicts a representative temperature distribution through cross-flow heat exchanger 102. More specifically, at any given time of steady state flow, at tube and fin portion 108 the material of the cross-flow heat exchanger 102 may be at a mean temperature 118, at tube and fin portion 110 the material of the cross-flow heat exchanger 102 may be at a mean temperature 120, and at tube and fin portion 112 the material of the cross-flow heat exchanger 102 may be at a mean temperature 122. As depicted, and considering that temperature distribution graph 116 is to the same scale as temperature distribution graph 30 of FIG. 2, and that heat exchangers 16, 102 are the same overall dimensions and specifications, except for the directional flow characteristics and baffle 64, 86, 95, area 124 represents less of a temperature variation than area 28 of FIG. 2, thus illustrating an advantage of the present disclosure. Stated differently, with less of a temperature variation between tube and fin portion 110 and tube and fin portion 112 of FIG. 10, mechanical strain on the material of the cross-flow heat exchanger 102 is less than that of area 28 of FIG. 2.

Figure 11:
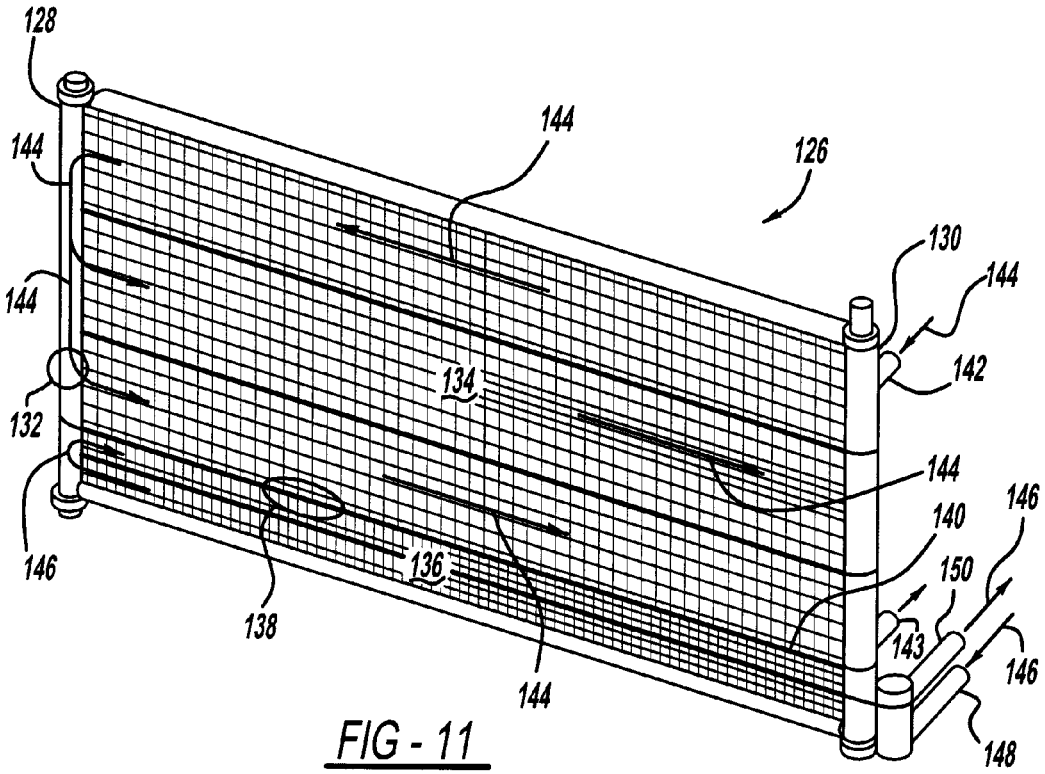
FIG. 11 is a perspective view of a multi-cooler heat exchanger equipped with a baffle in accordance with the present disclosure.

FIG. 11 depicts a multi-cooler heat exchanger 126 to which an internal baffle within a header tank may be applied. More specifically, multi-cooler heat exchanger 126 may be equipped with a header tank 128 and a header tank 130, either of which may contain a baffle such as any of baffles 64, 86, 95 as explained above in area 132. Multi-cooler heat exchanger 126 is one overall structure with separate internal, and fluidly separate cooling locations such that two different liquids may be separately cooled at the same time, yet not experience any mixing between the two liquids. More specifically, multi-cooler heat exchanger 126 may be equipped with tube and fin section 134 and tube and fin section 136 that each may contain a different fluid to cool. For instance, tube and fin section 134 may contain a liquid engine coolant while tube and fin section 136 may contain a liquid transmission coolant. Regardless of what devices tube and fin sections 134, 136 cool, header tanks 128, 130 may be equipped with a baffle 64, 86, 95 in baffle area 132 of header tank 128 to limit coolant flow and heat transfer to thereby lessen thermal strain in, for example, area 138, which is a boundary between the two tube and fin sections 134, 136. More specifically, partition 140 may be a dividing point between tube and fin section 134 and tube and fin section 136. An engine coolant may enter heat exchanger 126 at inlet 142 and traverse a path indicated with fluid 144 and exit at outlet 143. During passage through header tank 128, baffle within baffle area 132 may restrict the volume of fluid that passes into the lowest chamber of tube and fin section 134 that abuts the highest chamber of tube and fin section 136, thus reducing thermal strain along area of partition 140 of the heat exchanger 126 because fluid 144 may be at it coolest in the lowest chamber of tube and fin section 134. Fluid 146 entering inlet 148 is cooled before passing into the upper chamber of tube and fin section 136 and subsequently exiting from outlet 150. Tube and fin sections 134, 136 may be equipped with tubes 66 and fins 68 depicted in FIG. 5. If so equipped, tubes 66 may run horizontally across heat exchanger 126 to fluidly link header tanks 126, 130.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A heat exchange system comprising:

a single-phase fluid heated by a device, wherein the fluid is a liquid coolant flowing through the heat exchanger that does not undergo a phase change during operation of the heat exchanger;

a first header tank having a single inlet allowing the fluid into the first header tank from the device;

a second header tank having a single outlet allowing the fluid into the device from the second header tank;

a core section including:

a first plurality of tubes fluidly joining the first header tank and the second header tank, the fluid in the first plurality of tubes flowing from the first header tank to the second header tank; and a second plurality of tubes fluidly joining the first header tank and the second header tank, the fluid in the second plurality of tubes flowing from the first header tank to the second header tank; and a baffle within the first header tank, the baffle extending across an entire width and an entire depth of the first header tank to divide the first header tank into a first chamber in direct communication with the first plurality of tubes and a second chamber in direct communication with the second plurality of tubes, and a communication portion which communicates the first chamber and the second chamber, is provided in the baffle; wherein the baffle is disposed upstream of the fluid flow in the first and second plurality of tubes;

a first portion of the fluid introduced into the first header tank through the first inlet flows from the first chamber to the second header tank through the first plurality of tubes, and out from within the second header tank through the outlet; and a second portion of the fluid introduced into the first header tank through the inlet flows from the first chamber directly to the second chamber through the communication portion of the baffle, from the second chamber to the second header tank through the second plurality of tubes, and out from within the second header tank through the outlet.

2. The system according to claim 1, wherein the heat exchanger is a radiator within a vehicle and the baffle is located in a header tank positioned substantially parallel to a surface of ground upon which the vehicle rests.

3. The system according to claim 1, wherein the heat exchanger is a radiator within a vehicle and the baffle is located in a header tank positioned substantially perpendicular to a surface of ground upon which the vehicle rests.

4. The system according to claim 1, wherein the baffle is a wall that defines only one slot.

5. The system according to claim 1, wherein the baffle is a wall that defines only one slot that is open through one side of the wall.

6. The system according to claim 1, wherein the baffle is a wall that defines a plurality of slots.

7. The system according to claim 1, wherein the baffle is a wall that defines a plurality of holes.

8. The system according to claim 1, wherein the communication portion is an opening defined by the baffle configured to direct the fluid through the baffle.

9. The system according to claim 8, wherein the opening defined by the baffle is configured to direct the fluid linearly through the baffle in a direction perpendicular to a length of the baffle.

10. The system according to claim 1, wherein the first portion of the fluid and the second portion of the fluid mix in the second header tank.

11. A heat exchange system comprising:

a first header tank including an inlet and an outlet;

a single-phase fluid, wherein the fluid is a liquid coolant that does not change phase as the liquid coolant flows from the inlet to the outlet;

a baffle within the first header tank between the inlet and the outlet, the baffle defining an opening therethrough configured to permit the fluid to flow through the baffle and reduce a flow rate of the fluid flowing through the baffle;

a partition wall within the first header tank between the baffle and the outlet;

a first tank chamber defined between the inlet and the baffle;

a second tank chamber defined between the baffle and the partition wall, the baffle is configured to permit flow of the fluid directly from the first chamber to the second chamber;

a third tank chamber defined between the partition wall and the outlet, the second tank chamber is between the first and the third tank chambers, the partition wall configured to prevent flow of the fluid from the second chamber directly into the third chamber;

a second header tank;

a first plurality of tubes extending from the first tank chamber to the second header tank;

a second plurality of tubes extending form the second tank chamber to the second header tank;

a third plurality of tubes extending from the second header tank to the third tank chamber;

wherein:

a first portion of the fluid introduced into the first header tank through the inlet flows from the first chamber to the second header tank through the first plurality of tubes, from the second header tank to the third chamber through the third plurality of tubes, and out from within the first header tank through the outlet;

a second portion of the fluid introduced into the first header tank through the inlet flows from the first chamber directly to the second chamber through the opening of the baffle, from the second chamber to the second header tank through the second plurality of tubes, from the second header tank to the third chamber through the third plurality of tubes, and out from within the first header tank through the outlet; and the baffle decreases the flow rate of the second portion of the fluid as the second portion of fluid flows through the opening defined by the baffle.

12. The heat exchange system of claim 11, wherein the second header tank defines only a single chamber.

13. The heat exchange system of claim 11, wherein the partition wall is solid, the inlet is a single inlet of the first header tank, and the outlet is a single outlet of the first header tank.

14. The heat exchange system of claim 11, wherein the first portion of the fluid and the second portion of fluid mix in the second header tank.

15. The heat exchange system of claim 11, wherein the baffle extends across an entire width and an entire depth of the first header tank.

16. The heat exchange system of claim 11, wherein:

the first plurality of tubes include a plurality of first fins therebetween;

the second plurality of tubes include a plurality of second fins therebetween; and the third plurality of tubes include a plurality of third fins therebetween.

17. The heat exchange system of claim 11, wherein the heat exchanger is a vehicle radiator.

18. A heat exchange system comprising:

a first header tank including an inlet and an outlet;

a single-phase fluid, wherein the fluid is a liquid coolant that does not change phase as the liquid coolant flows from the inlet to the outlet;

a partition wall in the first header tank between the inlet and the outlet defines a first tank chamber at an inlet side of the partition wall and a second tank chamber at an outlet side of the partition wall, the partition wall prevents flow of the fluid directly from the first tank chamber to the second tank chamber;

a second header tank;

a baffle within the second header tank defining an opening therethrough configured to permit the fluid to flow through the baffle and to reduce a flow rate of the fluid flowing through the baffle;

the baffle defines a third tank chamber on an upstream side of the baffle and a fourth tank chamber on a downstream side of the baffle;

a first plurality of tubes extending from the first tank chamber of the first header tank to the third tank chamber of the second header tank; and a second plurality of tubes extending from the fourth tank chamber of the second header tank to the second tank chamber of the first header tank; and a third plurality of tubes extending from the third tank chamber of the second header tank to the second tank chamber of the first header tank;

wherein:

the fluid introduced into the first header tank through the inlet flows from the first tank chamber to the third tank chamber of the second header tank through the first plurality of tubes, a first portion of the fluid introduced into the third tank chamber flows from the third tank chamber to the second tank chamber through the third plurality of tubes, and out from within the first header tank through the outlet;

a second portion of the fluid introduced into the third tank chamber flows from the third tank chamber directly to the fourth tank chamber through the opening of the baffle, from the fourth tank chamber to the second tank chamber through the second plurality of tubes, and out from within the first header tank through the outlet; and the baffle decreases the flow rate of the fluid as the fluid flows through the opening defined by the baffle.

19. The heat exchange system of claim 18, wherein the heat exchanger is a radiator of a vehicle.

20. The heat exchange system of claim 18, wherein the partition wall is solid, the inlet is a single inlet of the first header tank, and the outlet is a single outlet of the first header tank.

21. The heat exchange system of claim 18, wherein the baffle extends across an entire width and an entire depth of the second header tank.

22. The heat exchange system of claim 18, wherein:

the first plurality of tubes include a plurality of first fins therebetween; and the second plurality of tubes include a plurality of second fins therebetween.

23. The heat exchange system of claim 22, wherein the fluid is a first fluid, the inlet is a first inlet, the outlet is a first outlet, and the partition wall is a first partition wall, the heat exchanger further comprising:

a second partition wall in the first header tank defining a fifth chamber on a side of the second chamber opposite to the first chamber such that the second chamber is between the first and fifth chambers, the second partition wall prevents direct fluid communication between the second and fifth chambers;

a third partition wall in the first header tank on a side of the second partition wall opposite to the second chamber to define a sixth chamber on a side of the fifth chamber opposite to the second chamber, the fifth chamber is between the second and the sixth chambers, the third partition wall prevents direct fluid communication between the fifth and sixth chambers;

a fourth partition wall in the second header tank defining a seventh chamber on a side of the fourth chamber opposite to the third chamber such that the fourth chamber is between the third and the seventh chambers, the fourth partition wall prevents direct fluid communication between the fourth and seventh chambers; and a second inlet and a second outlet of the first header tank, the second inlet in fluid communication with the sixth chamber and the second outlet in fluid communication with the fifth chamber;

a fourth plurality of tubes extending from the sixth chamber to the seventh chamber; and a fifth plurality of tubes extending from the seventh chamber to the fifth chamber, the fourth plurality of tubes are between the second plurality of tubes and the fifth plurality of tubes;

wherein:

a second fluid, which is different and separate from the first fluid, introduced into the sixth chamber of first header tank through the second inlet flows from the sixth chamber to the seventh chamber through the fifth plurality of tubes, from the seventh chamber to the fifth chamber of the first header tank through the fourth plurality of tubes, and out from within the fifth chamber and the first header tank through the second outlet.

24. The heat exchange system of claim 23, wherein:

the fourth plurality of tubes include a plurality of third fins therebetween; and the fifth plurality of tubes include a plurality of fourth fins therebetween.

25. The heat exchange system of claim 24, wherein the second fluid does not change phase as the second fluid flows from the second inlet to the second outlet.

* * * * *